US007251887B2

(12) United States Patent
Tench, Jr. et al.

(10) Patent No.: US 7,251,887 B2
(45) Date of Patent: Aug. 7, 2007

(54) TOOL FOR BALANCING ROTATING COMPONENTS

(75) Inventors: Thomas J. Tench, Jr., Phoenix, AZ (US); William J. Clayton, Gilbert, AZ (US); Nguyen X. Nghiem, Phoenix, AZ (US)

(73) Assignee: Honeywell International, Inc., Morristown, NJ (US)

( * ) Notice: Subject to any disclaimer, the term of this patent is extended or adjusted under 35 U.S.C. 154(b) by 494 days.

(21) Appl. No.: 10/728,678

(22) Filed: Dec. 4, 2003

(65) Prior Publication Data

US 2005/0120554 A1 Jun. 9, 2005

(51) Int. Cl.

| | |
|---|---|
| ***B23P 6/00*** | (2006.01) |
| ***B23P 15/02*** | (2006.01) |
| ***B24B 55/04*** | (2006.01) |
| *B24B 1/00* | (2006.01) |

(52) U.S. Cl. ..... 29/889.1; 29/23.51; 451/457; 451/29

(58) Field of Classification Search ..... 29/23.51, 29/889.1, DIG. 19, DIG. 26, 889, 901, 557; 451/451, 454, 457, 460, 29, 30, 237, 281, 451/282, 286

See application file for complete search history.

(56) References Cited

U.S. PATENT DOCUMENTS

| | | | | |
|---|---|---|---|---|
| 2,467,376 | A * | 4/1949 | Francis, Jr. | 310/28 |
| 3,608,349 | A * | 9/1971 | Greiner et al. | 72/146 |
| 3,811,327 | A | 5/1974 | Hack | |
| 4,380,925 | A | 4/1983 | Martino | |
| 5,791,595 | A | 8/1998 | Jamieson | |
| 6,402,467 | B1 | 6/2002 | Godichon et al. | |

* cited by examiner

*Primary Examiner*—David P. Bryant
*Assistant Examiner*—Christopher M. Koehler
(74) *Attorney, Agent, or Firm*—Ingrassia Fisher & Lorenz

(57) ABSTRACT

A tool for limiting a cut on an impeller having a shaft and vane is provided. The tool includes a shield member having a sidewall, a top, and an inner cavity. The tool also includes a first cut opening extending through the hub sidewall to the shield member inner cavity, the shield member configured to matingly receive the impeller shaft into the shield member inner cavity and position at least a portion of the impeller shaft proximate the at least one cut opening to expose the portion of the impeller shaft for grinding.

6 Claims, 4 Drawing Sheets

TOOL FOR BALANCING ROTATING COMPONENTS

FIELD OF THE INVENTION

The present invention relates to gas turbine engine repair tools and, more particularly, to a device used to balance a replacement impeller of a gas turbine engine, such as those found on aircraft and other vehicles.

BACKGROUND OF THE INVENTION

Jet engines (also called gas turbine engines) are generally designed and built robustly and safely. Nonetheless, these well-designed engines may need to undergo periodic maintenance and/or repair. Such maintenance and repair operations may include partial or complete disassembly of the engine, and removal, repair, or replacement, of one or more components within the engine. Some of the components may be installed in the engine according to relatively tight tolerances. Although these same components may be manufactured to within design specification tolerances, manufacturing variation may still exist. Thus, engine re-assembly following maintenance and/or repair may include instances in which these variations are accounted for by, for example, cutting and/or reconfiguring portions of the pre-manufactured replacement parts.

For example, in the compressor section of a jet engine, it is desirable to have balanced axial rotation of the compressor impeller. Occasionally, when a compressor impeller is replaced, the replacement impeller may rotate in an imbalanced manner. Thus, in such cases, typically, portions of the impeller shaft are either cut or grinded away. At times, the grinding tool operator may inadvertently grind too much of the impeller shaft or may miscut the impeller by cutting or grinding the impeller vanes. Generally, when a misgrind or miscut is made on an impeller, the compressor impeller is rendered non-serviceable and is typically discarded.

Therefore, there is a need for an apparatus that addresses one or more of the above-noted drawbacks. An apparatus that allows accurate grinding and cutting of the impeller shaft for rotational balance within a jet engine is desirable. It is also desirable for the apparatus to be inexpensive and easy to use. The present invention addresses one or more of these needs.

SUMMARY OF THE INVENTION

The present invention provides a tool for limiting a cut on an impeller having a shaft and vane, the shaft including a bore extending therethrough. In one embodiment, the tool comprises a shield and one or more cut openings. The shield includes a sidewall, a top, and an inner cavity, while the one or more cut openings extend through the shield sidewall to the shield inner cavity. Additionally, the shield is configured to matingly receive the impeller shaft into the shield inner cavity and to position at least a portion of the impeller shaft proximate each cut opening to thereby expose the portion of the impeller shaft for grinding.

In another embodiment, and by way of example only, a method for grinding an impeller shaft for balance is provided. The method includes the steps of positioning a tool onto the impeller shaft and grinding the impeller shaft. Specifically, the tool comprises a shield having a sidewall, a top, and an inner cavity and one or more cut openings extending through the shield sidewall to the shield inner cavity, wherein the shield is configured to matingly receive the impeller shaft into the shield inner cavity and position at least a portion of the impeller shaft proximate each cut opening to thereby expose the portion of the impeller shaft for grinding. The method also includes the step of grinding the impeller shaft at the exposed portion of the impeller shaft.

Other independent features and advantages of the preferred tool will become apparent from the following detailed description, taken in conjunction with the accompanying drawings which illustrate, by way of example, the principles of the invention.

DETAILED DESCRIPTION OF A PREFERRED EMBODIMENT

Before proceeding with a detailed description of the various embodiments, it is to be appreciated that the tool described below may be used in conjunction with various types of gas turbine engines, such as an aircraft turbofan jet engine, that include one or more rotating shafts. The skilled artisan will appreciate that the below description, when referring to a turbofan jet engine, encompasses either single stage or multistage jet engine architectures. Thus, although the present invention is, for convenience of explanation, depicted and described as being implemented with a two-stage turbofan jet engine, it will be appreciated that it can be implemented with other engine designs.

Figure 1:
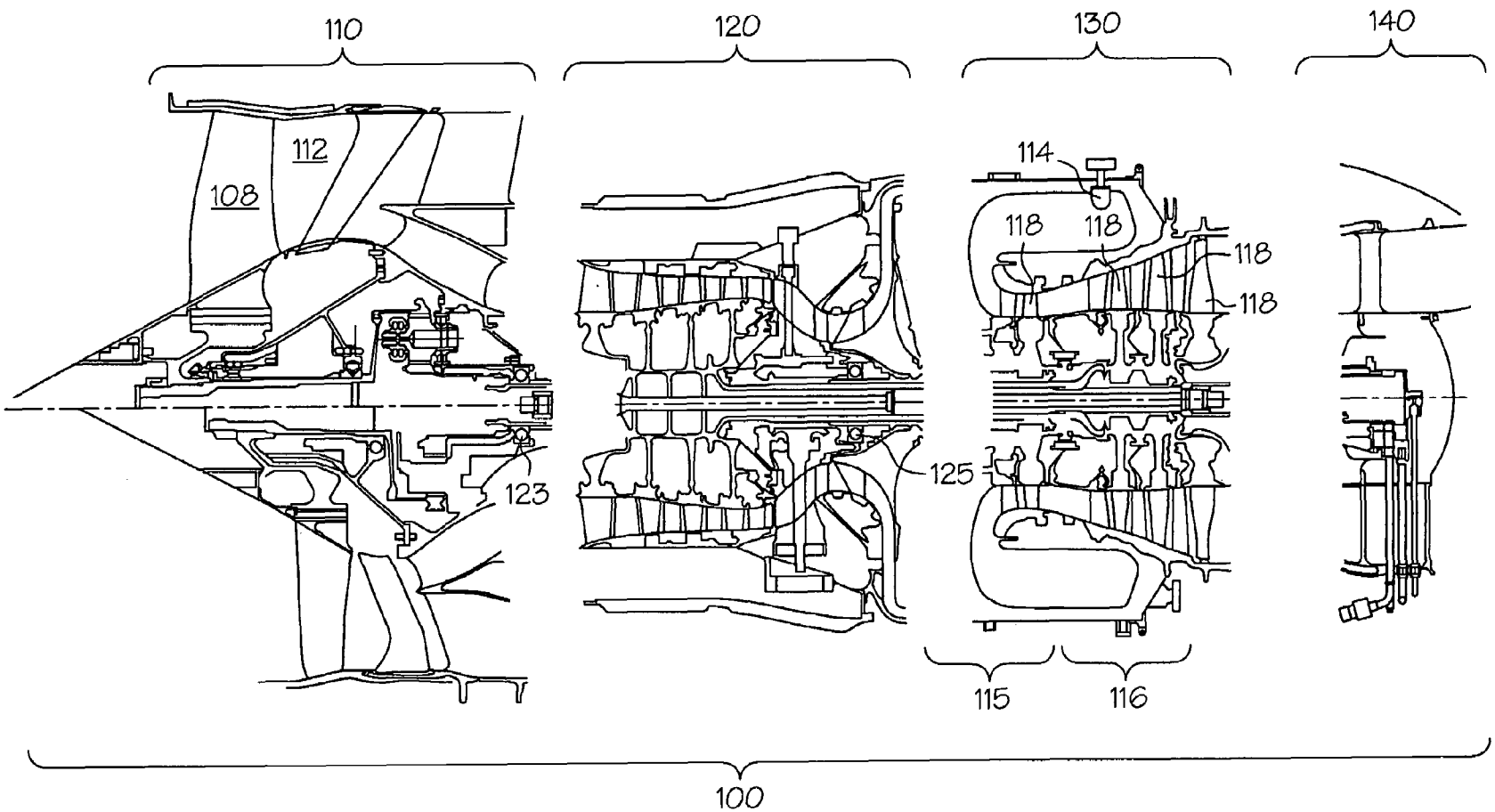
FIG. 1 is a partial cross-section side view of a gas turbine engine with the major sections of the engine separate from one another.

Turning now to the description, and with reference first to FIG. 1, a partial cross-section side of a turbofan jet engine, with which the novel impeller balancing tool 300 may be used, is depicted. As this figure illustrates, a turbofan jet engine 100 includes at least four major modules. These major modules include a fan module 110, a compressor module 120, a combustion and turbine module 130 and an exhaust module 140.

The fan module 110 is positioned at the front, or "inlet" section of the engine 100, and includes a fan 108 that induces air from the surrounding environment into the engine 100. The fan module 110 accelerates a fraction of this air toward the compressor module 120, and the remaining fraction is accelerated into and through a bypass 112, and out the exhaust module 140. The compressor module 120 raises the pressure of the air it receives to a relatively high level.

This high-pressure compressed air then enters the combustion and turbine module 130, where a ring of fuel nozzles 114 (only one illustrated) injects a steady stream of fuel. The injected fuel is ignited by a burner (not shown), which significantly increases the energy of the high-pressure compressed air. This high-energy compressed air then flows first into a high pressure turbine 115 and then a low pressure turbine 116, causing rotationally mounted turbine blades 118 on each turbine 115, 116 to turn and generate energy. The energy generated in the turbines 115, 116 is used to power other portions of the engine 100, such as the fan module 110 and the compressor module 120. The air exiting the combustion and turbine module 130 then leaves the engine 100 via the exhaust module 140. The energy remaining in the exhaust air aids the thrust generated by the air flowing through the bypass 112.

Figure 2:
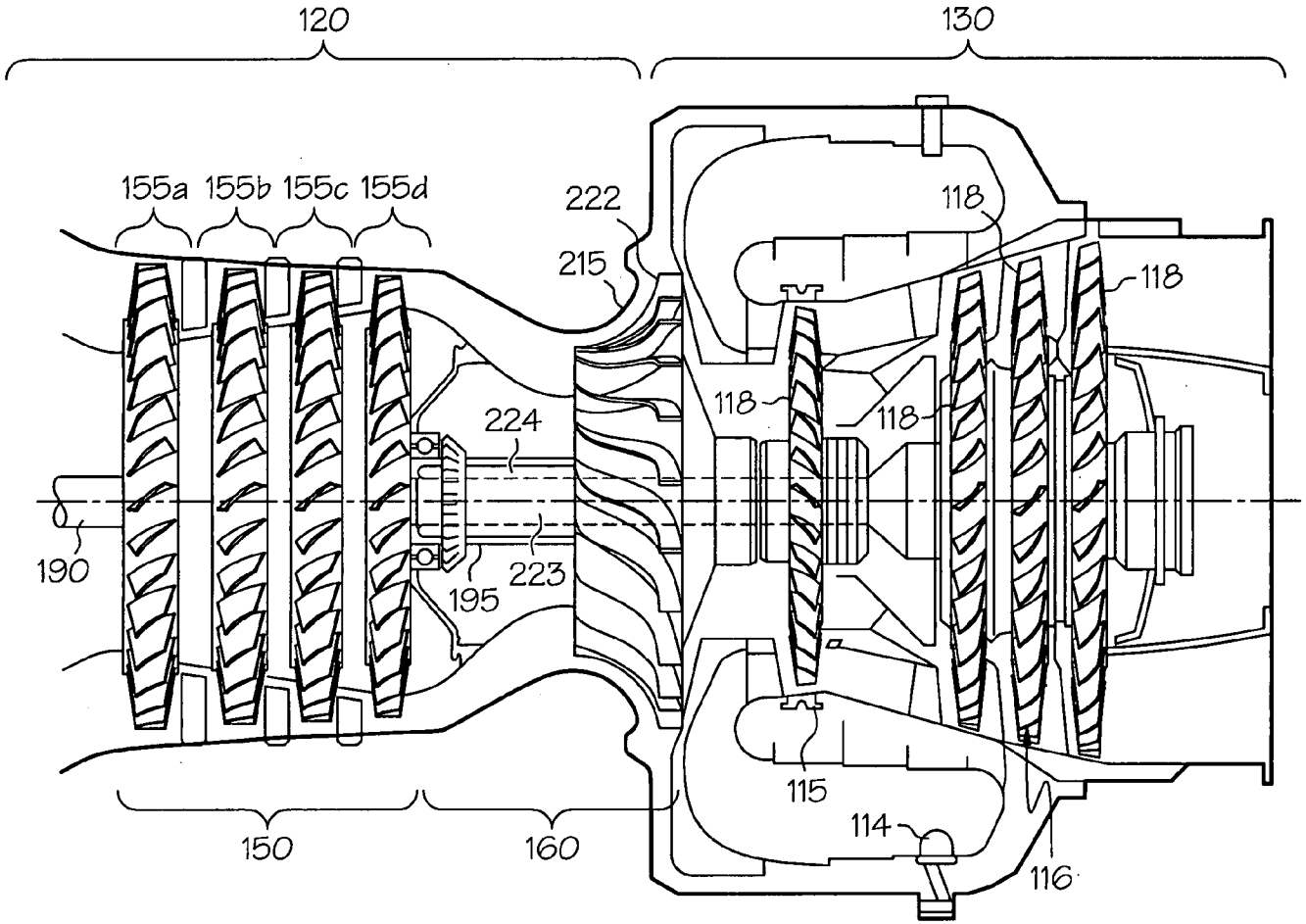
FIG. 2 is a close up cross-section side view of the compressor, combustion and turbine sections of a gas turbine engine depicted in FIG. 1.
Figure 3:
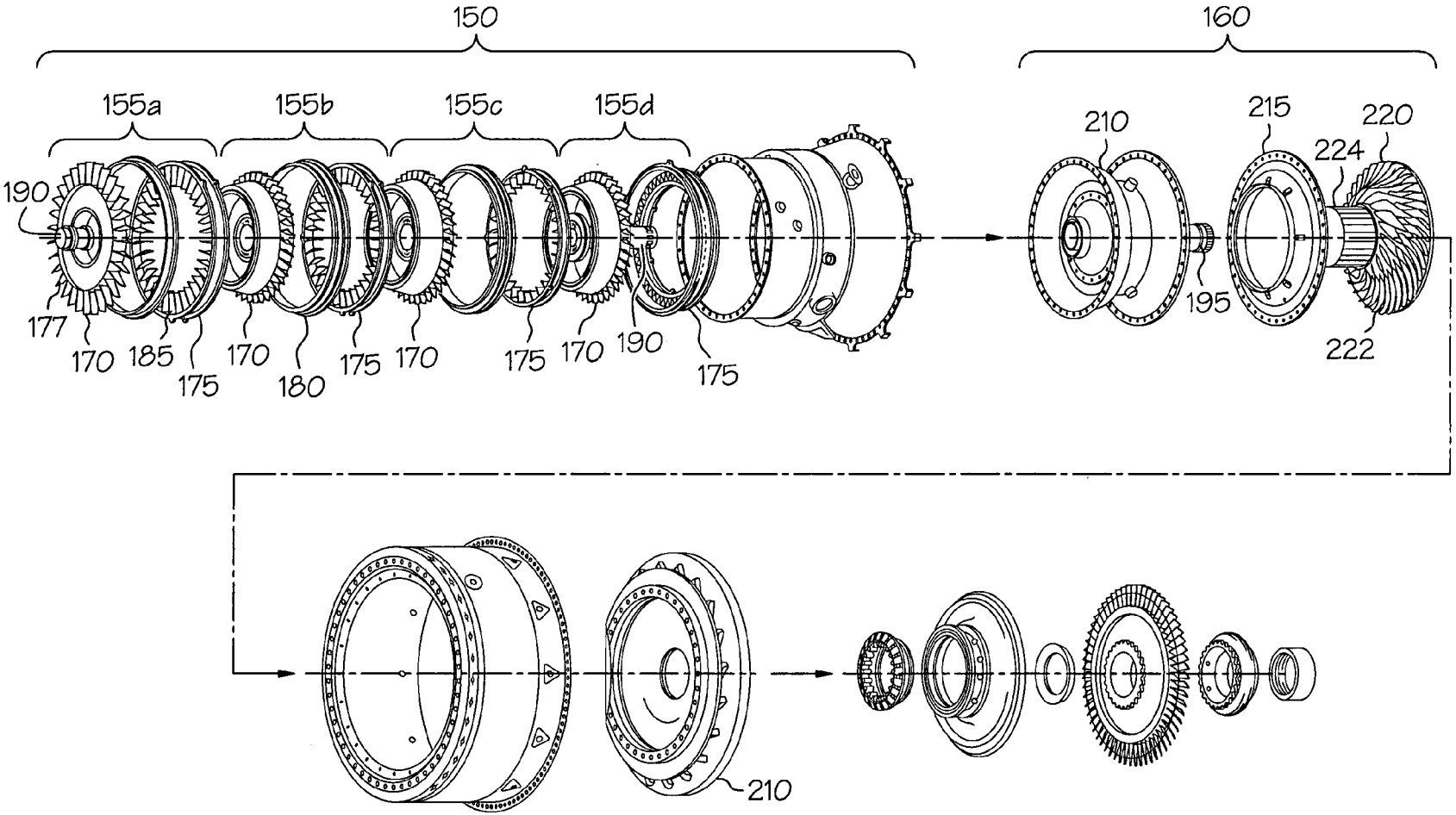
FIG. 3 is an exploded view of the compressor section depicted in FIG. 2.

With reference now to FIGS. 2 and 3, a more detailed description of the compressor module 120 will be provided. As shown, the compressor module 120 includes a low pressure section 150 and a high pressure section 160. The low pressure section 150 includes four stages 155*a-d*, each of which includes four rotors 170 and four stators 175. Each of the rotors 170 has a plurality of blades 177 and is surrounded by a shroud 180. As shown more clearly in FIGS. 2 and 3, each of the rotors 170 is rotationally mounted on a low pressure shaft 190, which is driven by the low pressure turbine 116. As the rotors 170 rotate, the blades 177 force air through each of the stators 175 in subsequent sections. Each stator 175 also includes a plurality of vanes 185. As the air from the rotors 170 travels across the vanes 185, it is forced to travel at a substantially optimum angle to the next stage, thereby increasing the air pressure as the air travels from stage to stage.

The high pressure section 160 includes a high pressure diffuser case 210, a shroud 215, and a high pressure impeller 220. The high pressure diffuser case 210 couples the low pressure section 150 to the high pressure section 160 and directs the air exhausted from the fourth stage 155*d* of the low pressure section 150 at the appropriate angle into high pressure impeller 220. The shroud 215 is mounted to the diffuser case 210 and surrounds a portion of the high pressure impeller 220.

The high pressure impeller 220 has a plurality of vanes 222 that flare radially outwardly, an impeller shaft 224 that protrudes outwardly from the flared plurality of vanes 222, and a longitudinal bore 223 that extends throughout. The impeller shaft 224 may vary in length, and is configured to engage with a high pressure section shaft 195 and aid in mounting the impeller 220 on to the high pressure section shaft 195. The high pressure section shaft 195, as shown more clearly in FIG. 1, is rotationally supported by a first set of bearings 123 and a second set of bearings 125. The high pressure section shaft 195 surrounds the low pressure shaft 190, and is driven by the high pressure turbine 115. Thus, the high pressure section shaft 195 rotates independently of the low pressure shaft 190. As shown more clearly in FIG. 2, the shroud 215 and the vanes 222 flare radially outwardly. The balance during spin rotation of the shaft and the high pressure and low pressure section components that rotate axially around the spin axis of the shaft is important for optimum engine performance as well.

Figure 4:
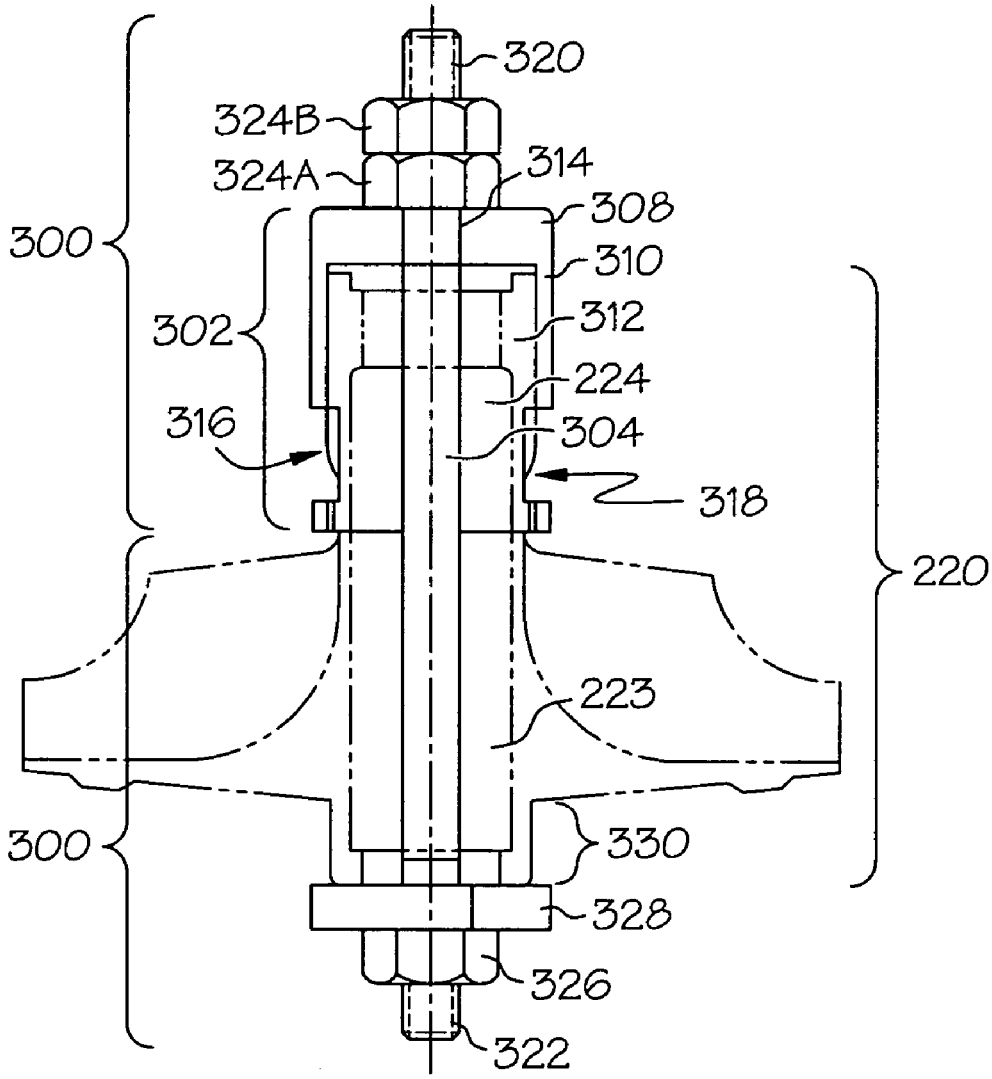
FIG. 4 is a cross section view of an exemplary embodiment of the tool positioned on an impeller.

During assembly, or during engine maintenance, repair and/or overhaul of the engine 100, an impeller 220 having optimal balance is needed to obtain substantially optimal engine performance. Occasionally, off-the-shelf pre-manufactured impellers may be manufactured off-balance. In such case, it is preferable for portions of the impeller to be grinded down or removed to achieve axial rotative balance. To do so, a tool 300 is preferably employed to aid in the grinding process. Tool 300, according to an exemplary embodiment, is illustrated in FIG. 4 and is shown engaged with impeller 220.

Tool 300 comprises several components including a shield 302, a rod 304, a plurality of nuts 324A, 324B, 326 and a washer 328. Each of these components will now be discussed.

The shield 302 preferably has a cap-like configuration, and includes a top 308, sidewall 310 and an inner cavity 312. A central opening 314 extends from the top 308 to the inner cavity 312. The opening 314 is preferably located in the center of top 308 so as to be substantially in alignment with impeller longitudinal bore 223. The shield 302 also includes two cut openings 316, 318 that each extend from a portion of the sidewall 310 to the inner cavity 312. The cut openings 316, 318 are preferably machined and dimensioned such as to serve as windows to expose portions of the impeller shaft 224. Additionally, each of the cut openings 316, 318 are preferably machined directly opposite from one another so that equal grinding can be applied to the two exposed portions of the shaft 224. As will be appreciated, the cut openings 316, 318 may also be cut out of or punched into the shield 302 or formed in any one of numerous other fashions. Moreover, although only two cut openings are depicted, various other numbers of openings can be employed so long as the openings only expose the shaft 224. The shield 302 is preferably constructed from A2 or O1 steel, a nickel-based supperalloy, such as INCONEL® available through Special Metal Corporation of Huntington, W.Va., or one of numerous other relatively hard materials that may be difficult to grind by tools that are used to grind the impeller. It will be further appreciated that the shield 302 and the position of the cut openings 316, 318 are appropriately sized and shaped depending on the dimensions of the particular impeller and impeller shaft to be grinded.

The rod 304 includes a first end 320 and a second end 322, and is configured to be inserted through shield opening 314 and impeller longitudinal bore 223. The rod 304 may be moved axially within the impeller longitudinal bore 223 to aid in substantially fixing shield 302 in a particular position. Preferably, the rod first end 320 is positioned to extend above the shield opening 304. The rod first end 320 is preferably threaded to threadingly couple with a nut 324A. Alternatively, nut 324A may be pre-threaded onto the rod first end 320 and then welded in place, or may be integrally formed, welded or brazed in place, or coupled via fasteners so that when the rod 304 is inserted into the longitudinal bore 223, the nut 324A acts as a stop preventing the rod 304 from slipping into the bore 223. In either case, an additional nut 324B may also be employed.

The second rod end 322 protrudes out from the underside of the impeller vanes 222. The underside of the impeller vanes 222 includes an end surface 330 with which a washer 328 abuts. The washer 328 is preferably sized and configured to serve as a stop between the impeller end surface 330 and a nut 326. Both the rod end 322 and the nut 326 are preferably threaded and threadingly coupled to one another. Preferably, the nut 326 is tightened until the tool 300 is appropriately clamped onto the impeller 220.

The use of the tool 300 for grinding the impeller shaft 224 will now be discussed. Preferably, an imbalanced impeller 220 is identified and the tool operator positions the imbalanced impeller 220 onto a surface. An appropriately sized shield 302 is placed over the impeller shaft 224 so that the cut openings 316, 318 expose the shaft 224. Once the shield 302 is properly positioned, rod 304, preferably having its first end 320 prethreaded with nut 324A, is inserted through the shield opening 314 and longitudinal bore 223 until the rod second end 322 protrudes out from the underside of the impeller vanes 222. Alternatively, the rod first end 320 is not prethreaded with nut 324 and after the rod 304 is inserted into the shield 302, nut 324A is then threaded onto the rod first end 320. In yet another embodiment, a nut 324B is threaded to rod first end 320 as well. Once the rod 304 is properly positioned, the washer 328 is engaged with rod second end 322 and placed adjacent to the impeller end surface 330. The second nut 326 is threadingly coupled to the rod second end 322 until the tool 300 is tightly clamped onto the impeller 220. The tool operator then preferably finds the cut openings 316, 318, grinds only the exposed portions of the impeller shaft 224 to remove an appropriate amount of the shaft material and achieve proper axial balance.

With the presence of the tool 300 during grinding, the tool operator avoids grinding or marring other portions of the impeller 220, such as the plurality of impeller vanes 222. As a result, the number of unusable, scrapped impellers is significantly reduced.

While the invention has been described with reference to a preferred embodiment, it will be understood by those skilled in the art that various changes may be made and equivalents may be substituted for elements thereof without departing from the scope of the invention. In addition, many modifications may be made to adapt to a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

We claim:

1. A tool for limiting a cut on an impeller having a shaft and vane, the shaft including a bore extending therethrough, the tool comprising:

a shield having a sidewall, a top, and an inner cavity, the sidewall having a bottom edge and a top edge, the bottom edge configured to contact the impeller vane, and the top edge joined with the top; and one or more cut openings extending through the shield sidewall to the shield inner cavity, the one or more cut openings formed between the sidewall top and bottom edges and located a predetermined distance away from the sidewall bottom edge;

a central opening extending through the shield top to the shield inner cavity; and a rod configured to insert through the central opening to adjustably move axially therein, the rod having at least a first end and a second end, the rod first end adapted to engage the impeller shaft bore, wherein the shield is configured to matingly receive the impeller shaft into the shield inner cavity and position at least a portion of the impeller shaft proximate each cut opening to thereby expose the portion of the impeller shaft for grinding.

2. The tool of claim 1, wherein the rod first end is threaded, and the tool further comprises:

a nut configured to threadingly couple to the rod first end.

3. The tool of claim 1, wherein the rod further includes a threaded second end and the tool further comprises:

a nut configured to threadingly couple to the threaded second end.

4. The tool of claim 1, wherein each cut opening is evenly spaced from one another.

5. The tool of claim 1, wherein the shield is made from a nickel-based superalloy.

6. A tool for limiting a cut on an impeller having a shaft and vane, the shaft including a bore extending therethrough, the tool comprising:

a shield having a sidewall, a top, and an inner cavity;

one or more cut openings extending through the shield sidewall to the shield inner cavity and a central opening extending through the shield member top to the shield member inner cavity; and a rod having at least a first end and a second end, the rod configured to insert through the shield central opening, wherein the shield is configured to matingly receive the impeller shaft into the shield inner cavity and the rod first end is adapted to engage the impeller shaft bore and adjustably move axially therein, the shield further configured to position at least a portion of the impeller shaft proximate each cut opening to thereby expose the portion of the impeller shaft for grinding.

* * * * *